US007558374B2

(12) United States Patent
Lemaitre

(10) Patent No.: US 7,558,374 B2
(45) Date of Patent: Jul. 7, 2009

(54) SYSTEM AND METHOD FOR GENERATING X-RAYS

(75) Inventor: Sergio Lemaitre, Shorewood, WI (US)

(73) Assignee: General Electric Co., Schenectady, NY (US)

( * ) Notice: Subject to any disclaimer, the term of this patent is extended or adjusted under 35 U.S.C. 154(b) by 36 days.

(21) Appl. No.: 11/685,036

(22) Filed: Mar. 12, 2007

(65) Prior Publication Data

US 2007/0183575 A1 Aug. 9, 2007

Related U.S. Application Data

(63) Continuation-in-part of application No. 10/904,229, filed on Oct. 29, 2004, now Pat. No. 7,206,379.

(51) Int. Cl.
*H01J 35/02* (2006.01)

(52) U.S. Cl. ..... 378/121; 378/10; 378/124; 378/143

(58) Field of Classification Search ..... 378/10, 378/92, 98.6, 113, 119, 121, 122, 124, 134, 378/136, 138, 143, 144
See application file for complete search history.

(56) References Cited

U.S. PATENT DOCUMENTS 3,239,711 A * 3/1966 Norris ..... 315/3.5
3,463,959 A * 8/1969 Jory et al. ..... 315/5
4,122,342 A 10/1978 Vali et al.
4,287,425 A 9/1981 Elliot, Jr.
4,641,103 A 2/1987 Madey et al.
4,746,839 A 5/1988 Kazusa et al.
5,044,006 A * 8/1991 Cyrulnik ..... 378/145
5,227,701 A * 7/1993 McIntyre ..... 315/5.41
5,227,733 A * 7/1993 Yamada ..... 315/500
5,635,721 A 6/1997 Bardi et al.
5,814,940 A 9/1998 Fujisawa
5,825,140 A 10/1998 Fujisawa
5,917,293 A 6/1999 Saito et al.
6,060,833 A * 5/2000 Velazco ..... 315/5.41
6,115,454 A 9/2000 Andrews et al.
6,201,851 B1 3/2001 Piestrup et al.
6,327,339 B1 12/2001 Chung et al.
6,376,990 B1 4/2002 Allen et al.
6,385,292 B1 * 5/2002 Dunham et al. ..... 378/122
6,407,505 B1 6/2002 Bertsche
6,493,424 B2 12/2002 Whitham
6,617,810 B2 9/2003 Symons
6,807,248 B2 * 10/2004 Mihara et al. ..... 378/10
6,826,254 B2 * 11/2004 Mihara et al. ..... 378/64
6,864,633 B2 3/2005 Trail et al.

(Continued)

FOREIGN PATENT DOCUMENTS

JP 03043999 A * 2/1991

*Primary Examiner*—Edward J Glick
*Assistant Examiner*—Thomas R Artman

(57) ABSTRACT

A system and method for generating X-rays comprising a waveguide having a cavity extending therethrough, a first sidewall, and a second sidewall opposite the first sidewall, the second sidewall having an opening extending therethrough forming or including a target therein. An electron emitter coupled to an inner surface of the first sidewall for emitting electrons into the cavity, microwaves coupled into the cavity generating an electric field for accelerating the electrons through the cavity and toward the target in the opening of the second sidewall for generating X-rays.

12 Claims, 5 Drawing Sheets

U.S. PATENT DOCUMENTS 6,987,361 B1 1/2006 Lewellen et al.
7,068,749 B2 * 6/2006 Kollegal et al. ..... 378/10
7,140,771 B2 * 11/2006 Leek ..... 378/203
7,142,629 B2 11/2006 Edie et al.
7,162,005 B2 * 1/2007 Bjorkholm ..... 378/57
2003/0002628 A1 1/2003 Wilson et al.
2004/0234023 A1 11/2004 Kollegal et al.
2005/0226363 A1 10/2005 Edie et al.

* cited by examiner

SYSTEM AND METHOD FOR GENERATING X-RAYS

CROSS-REFERENCE TO RELATED APPLICATIONS

This application is a continuation-in-part of and claims priority to U.S. patent application Ser. No. 10/904,229, filed Oct. 29, 2004, the disclosure of which is incorporated herein by reference.

BACKGROUND OF THE INVENTION

This disclosure relates generally to an assembly, system and method for generating X-rays. In particular, this disclosure relates to the use of an RF accelerator for generating X-rays and/or for accelerating electrons toward a target for generating X-rays in an imaging apparatus.

X-ray sources such as X-ray tubes generally include a cathode assembly and an anode assembly disposed within a vacuum vessel. The cathode assembly is positioned at some distance from the anode assembly, and a voltage differential is maintained therebetween in order to accelerate the electrons toward the anode. This voltage differential generates an electric field having a strength defined as the voltage differential between the anode and cathode divided by the distance therebetween. The anode assembly includes an anode having a target or impact zone that is generally fabricated from a refractory metal with a high atomic number, such as tungsten or any tungsten alloy. The anode is commonly stationary or a rotating disc. The cathode assembly emits electrons in the form of an electron beam that are accelerated across the potential difference and impact the target track of the anode at a high velocity. As the electrons impact the target, the kinetic energy of the electrons is converted to high-energy electromagnetic radiation, or X-rays. A portion of the X-rays are directed out of an X-ray transmissive window. The X-rays are then transmitted through an object such as the body of a patient and are intercepted by a detector that forms an image of the object's internal anatomy.

The X-ray sources are typically high voltage sources. For example, an X-ray tube assembly typically operates with high voltage fed by high voltage cabling that pass through the housing to the cathode. Such high voltage operation severely limits the design aspects of the X-ray source assembly because it requires the high voltage to be insulated from other components of the X-ray source assembly. A high voltage insulator is required to protect certain components from the high voltages within the X-ray source assembly. The high voltage insulator is typically bulky, expensive, and decreases reliability of the X-ray source.

In a typical CT imaging apparatus, an X-ray tube and an X-ray detector rotate on a gantry at very high speeds around a patient located on a table at the center of the gantry. Faster rotation speeds are desirable for certain imaging applications. For example, imaging the heart may require an image to be obtained between heartbeats. However, increased rotation speeds create increased forces potentially limiting the X-ray tube's operation or reliability.

By contrast, in a stationary CT imaging apparatus, the X-ray source is a stationary arc source with distributed focal spots that can be activated by a control unit. The X-ray source includes a high voltage insulator to protect certain components within the X-ray source from the high operating voltage of up to 150 kV or larger. As mentioned above, the insulator must be large which causes cost, space, weight, reliability, and high voltage stability concerns.

Therefore, there is a need for reducing the cost, size and complexity of X-ray sources, and providing an X-ray source that does not require high voltage insulation.

BRIEF DESCRIPTION OF THE INVENTION

In an embodiment, an X-ray source comprising a waveguide having a sidewall and a cavity extending therethrough, at least one electron emitter positioned on an inner surface of a first sidewall of the waveguide for generating at least one electron beam, and at least one stationary target positioned on an inner surface of a second sidewall receiving the at least one electron beam for generating X-rays.

In an embodiment, an annular X-ray source assembly comprising an annular waveguide having a cavity extending therethrough, a first sidewall, and a second sidewall opposite the first sidewall, a plurality of electron emitters placed on an inner surface of the first sidewall for generating electrons that are accelerated through the waveguide cavity, and a plurality of stationary targets placed in a plurality of openings extending through the second sidewall.

In an embodiment, an X-ray source comprising an X-ray tube, an accelerator coupled to the X-ray tube for accelerating at least one electron beam toward a rotating target of the X-ray tube, an electron emitter coupled to one side of the accelerator emitting electrons into a cavity of the accelerator, and an opening extending through an opposite side of the accelerator for the at least one electron beam to accelerate therethrough toward the rotating target.

In an embodiment, an X-ray source comprising a waveguide having a cavity extending therethrough, a first sidewall having an opening extending therethrough, and a second sidewall opposite the first sidewall, the second sidewall also having an opening extending therethrough; an electron emitter coupled to the opening of the first sidewall for emitting electrons into the cavity; and microwaves coupled into the cavity generating an electric field for accelerating the electrons through the cavity toward a target in the opening of the second sidewall for generating X-rays.

In an embodiment, a method for generating X-rays comprising emitting at least one electron beam from at least one electron emitter positioned at a first end of a waveguide, accelerating the at least one electron beam through a cavity within the waveguide with a microwave generated electric field coupled within the waveguide cavity, and directing the accelerated at least one electron beam to interact with at least one target positioned at a second end of the waveguide, the second end spaced apart and opposite the first end, for generating X-rays.

Various other features, objects, and advantages will be made apparent to those skilled in the art from the accompanying drawings and detailed description thereof.

DETAILED DESCRIPTION OF THE INVENTION

Figure 1A:
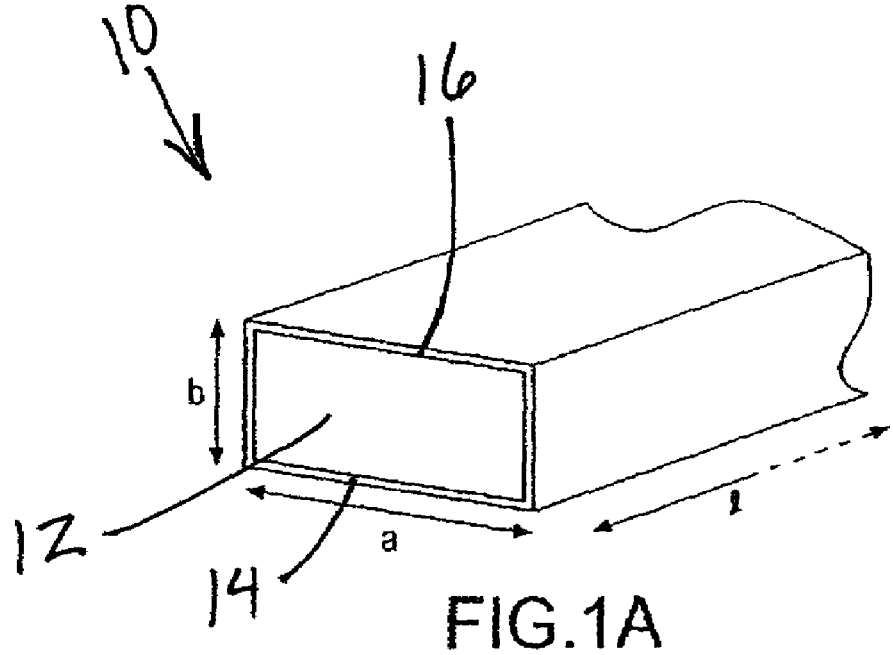
FIG. 1A is a schematic diagram of an exemplary waveguide.
Figure 1B:
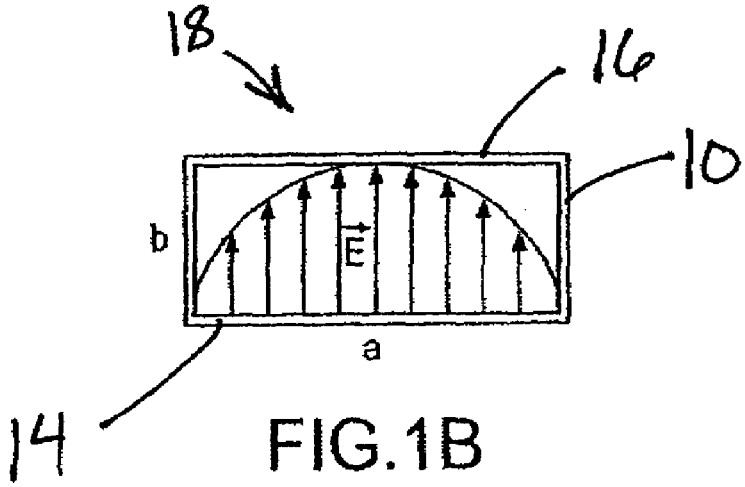
FIG. 1B is a graphical representation of an exemplary $TE_{10}$ mode electric field distribution in the waveguide of FIG. 1A.

Referring now to the drawings, FIGS. 1A and 1B, illustrate an example of a waveguide 10 and a graphical representation of an example $TE_{10}$ mode electric field distribution 18 within the waveguide 10 of FIG. 1A. A waveguide is a hollow structure of material boundaries that provides a path for guiding high-frequency electromagnetic waves or microwaves. The waveguide 10 shown in FIG. 1A has a rectangular cross-section with a width a, height b, length l, and cavity 12. The waveguide 10 further includes a first sidewall 14 and a second sidewall 16 opposite the first sidewall 14.

If an electron emitter were placed on an inner surface of the first sidewall 14 of the waveguide 10 and microwaves were coupled into the cavity 12, an electric field would accelerate the electrons across the cavity 12 towards the second sidewall 16. Electron energies of 100-200 keV are achievable across an acceleration path of a 1-2 cm. The fast electrons could then be used for X-ray generation in the conventional manner by interacting with a solid target.

It is possible to propagate several modes of electromagnetic waves or microwaves within a waveguide. The physical dimensions of a waveguide determine the cutoff frequency for each mode. If the frequency of the impressed signals above the cutoff frequency for a given mode, the electromagnetic energy can be transmitted through the cavity of the waveguide for that particular mode with minimal attenuation. Otherwise, the electromagnetic energy with a frequency below the cutoff frequency for that particular mode will be attenuated to a negligible value in a relatively short distance.

The dominant mode in a particular waveguide is the mode having the lowest cutoff frequency. For a rectangular waveguide this is the $TE_{10}$ mode. The TE (transverse electric) signifies that all electric fields are transverse to the direction of propagation and that no longitudinal electric field is present. The first index m in the $TE_{mn}$ notation indicates the number of half wave loops across the width a of the waveguide, and the second index n indicates the number of loops across the height b of the waveguide. For the $TE_{10}$ wave example, m=1 and n=0.

The cutoff frequency is determined by the geometry of the cavity, (i.e., width a, height b). The $TE_{10}$ mode (m=1, n=0) is only determined by the dimension a. For a=10 cm the cutoff frequency for this mode would be 1.5 GHz. This represents a typical value for the applications considered here. For electron beam currents of 1A and an accelerating voltage of the order of 150 kV the supplied microwave power P must at least be P=V*I=150 kV*1A=150 kW.

The cutoff frequency, $\lambda_c$, is determined by the geometry of the cavity (a, b) and integers (m, n).

$$\lambda_c = \frac{2}{\sqrt{\left(\frac{m}{a}\right)^2 + \left(\frac{n}{b}\right)^2}}$$

Also, the resonance frequency, $\lambda_r$, is determined by the geometry of the cavity (a, b, l) and integers (m, n, q).

$$\lambda_r = \frac{2}{\sqrt{\left(\frac{m}{a}\right)^2 + \left(\frac{n}{b}\right)^2 + \left(\frac{q}{l}\right)^2}}$$

For $TE_{10}$ mode, m=1, n=0, and the cutoff frequency is determined only by the width dimension, a. For a=10 cm the cutoff frequency, $\lambda_c$, would be 1.5 GHz. A resonant cavity with a cross-sectional dimension on the order of 10 cm could be readily integrated in existing CT and other X-ray imaging systems. For an electron beam current of 1A and an accelerating voltage on the order of 150 kV, the supplied microwave power must be at least 150 kW, or 150 kV*1A. A microwave generator providing GHz level microwave frequencies and mega watt power is known in the state of the art. A Klystron is just one example. A Klystron may be used for generating microwaves to be coupled to the waveguide cavity for generating electric fields in the waveguide cavity for accelerating electrons in an electron beam for generating X-rays from the electron beam hitting a target.

The microwave power, waveguide dimensions, and the phase of the electromagnetic waves or microwaves all determine the energy of the electrons impinging on the target. Accordingly, there is no need for a static high voltage to accelerate the electrons in an electron beam. Therefore, static high voltage stability is no longer a concern and there is no need for any high voltage insulation.

Figures 2A, 2B, 2C:
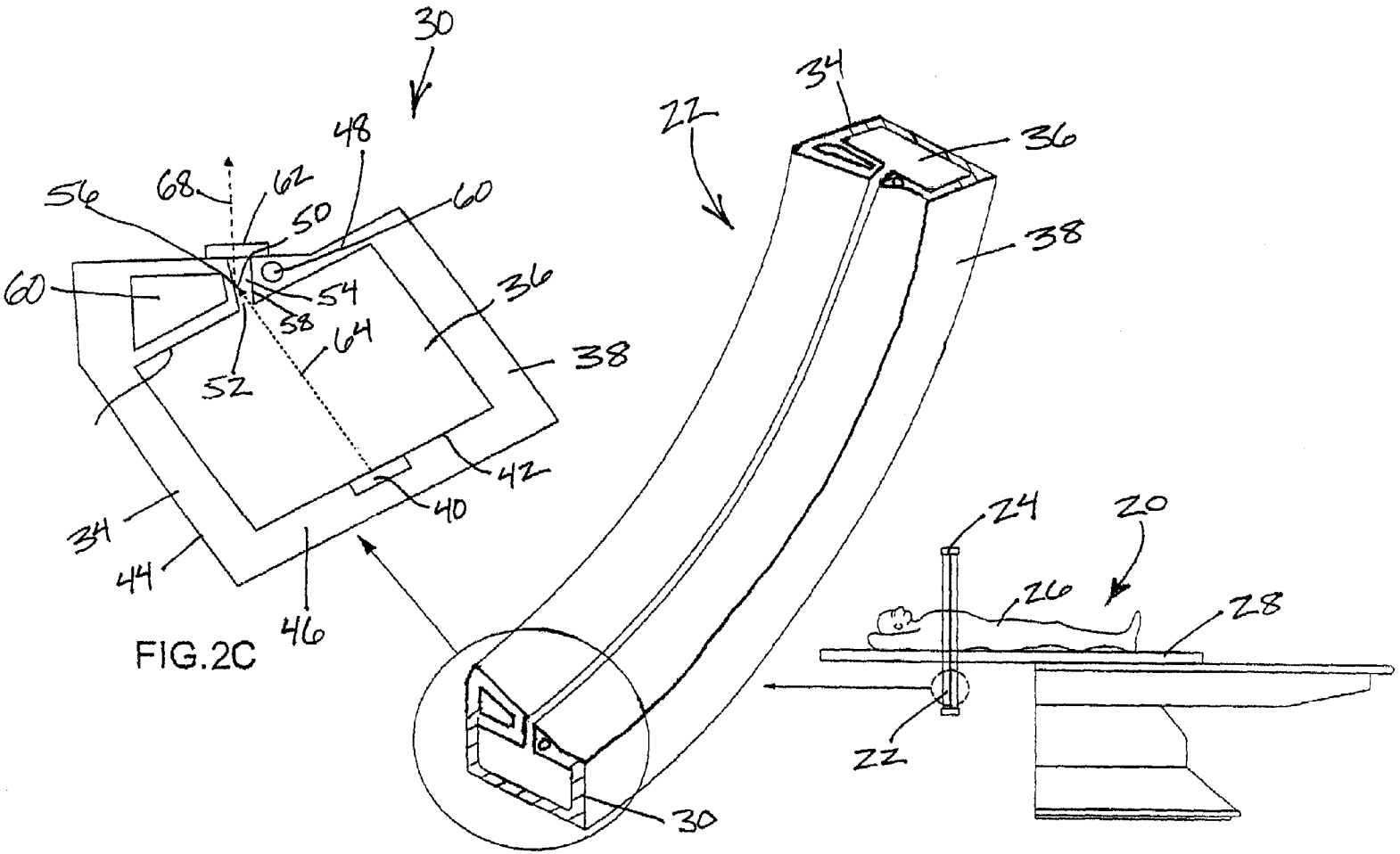
FIG. 2A is a schematic diagram of an exemplary embodiment of an imaging apparatus.
FIG. 2B is an enlarged diagram of a section of an exemplary embodiment of an annular X-ray source assembly of the imaging apparatus of FIG. 2A.
FIG. 2C is a cross-sectional view of an exemplary embodiment of an X-ray source from the section of X-ray source assembly of FIG. 2B.

FIG. 2A is a schematic diagram of an exemplary embodiment of an imaging apparatus 20. In an exemplary embodiment, the imaging apparatus 20 may be a stationary CT imaging apparatus. The imaging apparatus 20 includes at least one annular X-ray source assembly 22. The annular X-ray source assembly 22 and a detector assembly (not shown) are located in a ring gantry 24 that surrounds a patient 26 to be imaged, the patient 26 positioned on a table 28 at the center of the gantry 24. The at least one annular X-ray source assembly 22 includes a plurality of respective X-ray sources 30 spatially distributed along the annular X-ray source assembly 22. Each of the X-ray sources 30 includes at least one electron emitter 40 and at least one stationary target 50 disposed in a waveguide 34 in a spaced apart relationship. Therefore, the at least one annular X-ray source assembly 22 includes a plurality of electron emitters 40 and a plurality of stationary targets 50 spatially distributed along the annular X-ray source assembly 22. The plurality of X-ray sources 30 generates X-rays 68 for imaging the patient 26.

FIG. 2B is an enlarged diagram of a section of an exemplary embodiment of an annular X-ray source assembly 22 of the imaging apparatus 20 of FIG. 2A. The annular X-ray source assembly 22 comprises an annular waveguide 34 that functions as an electron beam accelerating structure or accelerator. The accelerator uses microwaves that are coupled to a cavity 36 within the waveguide 34 to create an electric field to accelerate at least one electron beam 64 from at least one electron emitter 40 toward at least one target 50 for generating X-rays 68.

FIG. 2C is a cross-sectional view of an exemplary embodiment of an X-ray source 30 from the section of X-ray source assembly 22 of FIG. 2B. The X-ray source 30 comprises a waveguide 34 having a cavity 36 extending therethrough, at least one electron emitter 40, and at least one stationary target 50. The waveguide 34 includes at least one sidewall 38 having an inner surface 42 and an outer surface 44. The at least one electron emitter 40 is positioned on the inner surface 42 of a first sidewall 46 of the waveguide 34, and the at least one stationary target 50 is positioned on the inner surface 42 of a second sidewall 48 of the waveguide 34. The second sidewall 48 being opposite the first sidewall 46. The at least one electron emitter 40 is spaced apart from the at least one target 50 by cavity 36. The cavity 36 is a vacuum chamber disposed within the at least one sidewall 38 between the at least one electron emitter 40 and the at least one target 50.

The second sidewall 48 includes at least one angled opening 52 extending therethrough forming at least one pathway 54 through the second sidewall 48. The at least one pathway 54 having two opposed sides 56, 58 with one of the sides 56 forming or including the at least one target 50. The at least one target 50 is adjacent to cavity 36.

The second sidewall 48 further includes at least one cooling channel 60 extending therethrough for cooling the at least one target 50 and target side 56, and the side 58 opposite the at least one target 50 that gets heated due to the impact of the electron beam, and backscatter of electrons and X-rays. A coolant is passed through the at least one cooling channel 60 to dissipate the heat.

The X-ray source 30 further includes a radiation window 62 attached to the outer surface 44 of the second sidewall 48 above the at least one target 50 and covering the at least one pathway 54. The radiation window 62 forms the exit path for the X-rays 68 produced by the X-ray source 30. The radiation window 62 comprises a material transparent to X-rays such as aluminum or beryllium.

The at least one electron emitter 40 is electrically at the same voltage potential as the at least one target 50. Both may be at a ground potential, or any other potential. The at least one electron emitter 40 generates at least one electron beam 64. The at least one electron beam 64 emitted from the at least one electron emitter 40 is accelerated through the vacuum chamber in cavity 36 toward the at least one target 50 in the at least one pathway 54. The accelerated electrons of the electron beam 64 are used to generate X-rays 68 in the conventional manner by interacting with the at least one target 50. The at least one electron beam 64 emanating from the at least one electron emitter 40 is incident on the at least one target 50 to produce X-rays. The at least one target 50 is at an obtuse angle with respect to the at least one incident electron beam 64. Focusing of the at least one electron beam 64 can be achieved by appropriately shaping the at least one electron emitter 40.

The at least one electron emitter 40 may be a thermionic emitter or a field emitter. For example, the at least one electron emitter 40 may be a field emitter array that is electrically gated and designed for emission of electrons into the vacuum chamber of cavity 36. This means that an electron beam is emitted from an electron emitter only where a gate of the electron emitter is open.

Figure 3:
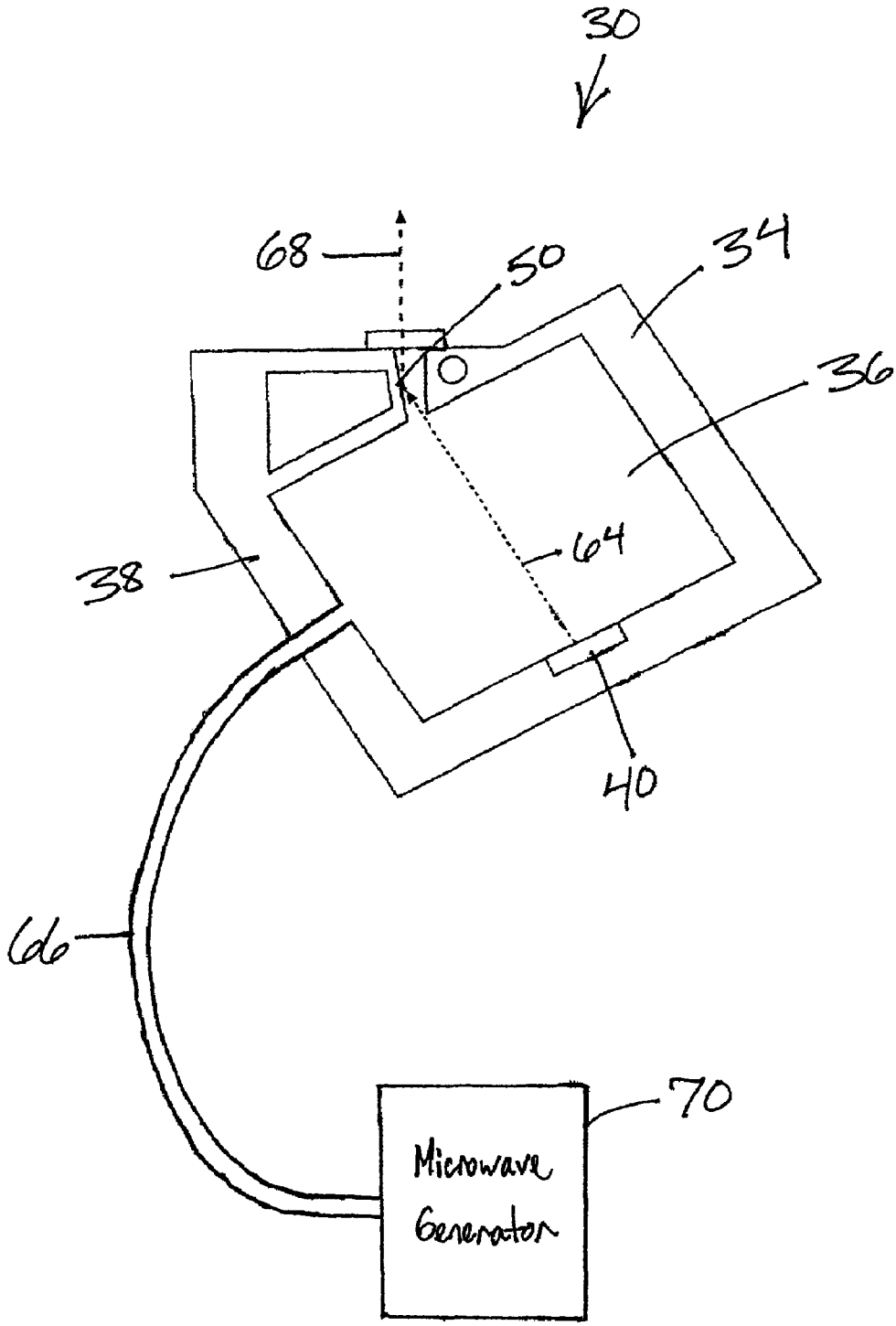
FIG. 3 is a cross-sectional view of an exemplary embodiment of an X-ray source with a microwave generator coupled to thereto.

FIG. 3 is a cross-sectional view of an exemplary embodiment of an X-ray source 30 with a microwave generator 70 coupled to thereto. The microwave generator 70 generates microwaves and transmits them to the cavity 36 of the waveguide 34 through a cable, waveguide, or other conduit 66. The conduit 66 is coupled through the sidewall 38 of the waveguide 34. The microwaves generated by a microwave generator 70 are coupled into the cavity 36 of the waveguide 34 to generate an electric field in the cavity 34 to accelerate the at least one electron beam 64 from the at least one electron emitter 40 toward the at least one target 50 for generating X-rays 68. The microwave generator 70 provides GHz microwave frequencies at mega watt power. The microwave generator 70 may be a Klystron, for example.

It is possible to generate oscillations of various configurations, namely standing or traveling waves, in the cavity 36 of waveguide 34 by appropriately tuning and terminating the resonant cavity 36. A significant advantage of using an accelerator to generate X-rays is the fact that strong electric fields greater than 10 kV/mm can be sustained in the resonant cavity 36 of the waveguide 34 without the need for high voltage insulation.

The microwave power, the waveguide dimensions, and the phase of the electromagnetic waves all determine the energy of the electrons hitting the at least one target. These dependencies can be utilized to generate electron beams with different average energies, which is of interest for specialized imaging techniques. Accordingly, there is no need for static high voltage to accelerate the electron beam. Therefore, static high voltage stability is no longer a concern and the need for bulky and costly high voltage insulation is eliminated.

Figure 4:
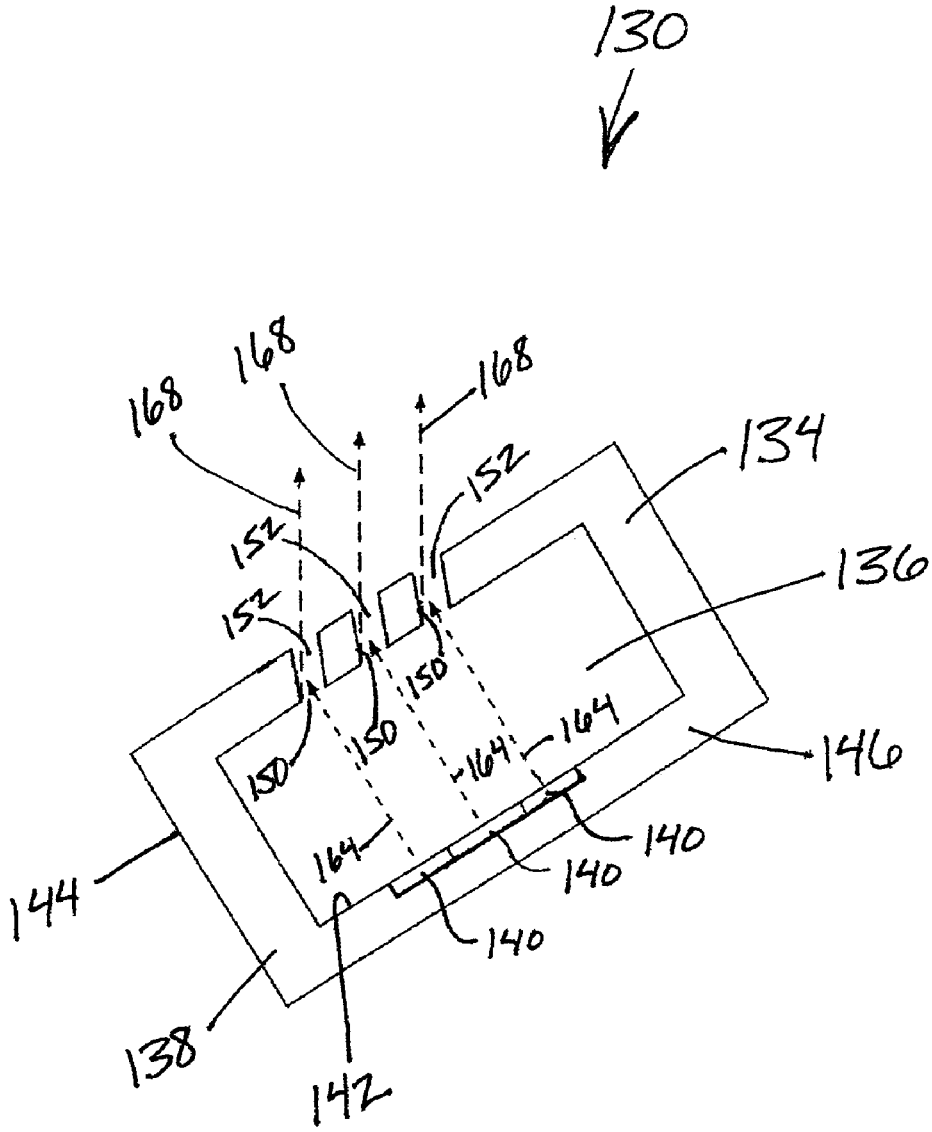
FIG. 4 is a cross-sectional view of an exemplary embodiment of an X-ray source.

FIG. 4 is a cross-sectional view of an exemplary embodiment of an X-ray source 130. The X-ray source 130 comprises a waveguide 134 having a cavity 136 extending therethrough, a plurality of electron emitters 140, and a plurality of stationary targets 150. The waveguide 134 includes at least one sidewall 138 having an inner surface 142 and an outer surface 144. The plurality of-electron emitters 140 are distributed along the inner surface 142 of a first sidewall 146 of the waveguide 134, and the plurality of stationary targets 150 are formed or positioned in a second sidewall 148 of the waveguide 134. The second sidewall 148 being opposite the first sidewall 146. The plurality of electron emitters 140 are spaced apart from the plurality of targets 150 by cavity 136. The cavity 136 is a vacuum chamber disposed within the at least one sidewall 138 between the plurality of electron emitters 140 and the plurality of targets 150.

The second sidewall 148 includes a plurality of angled openings 152 extending therethrough forming a plurality of targets in the second sidewall 148. The plurality of openings 152 each having two opposed sides 156, 158 with one of the sides 156 forming or including the target 150. The plurality of targets 150 are adjacent to cavity 136. The plurality of targets 150 may be used to collimate the X-rays and create a larger coverage area for an X-ray beam. FIG. 4 shows three openings 152 for example purposes only. The opening dimensions and number may be modified.

The plurality of electron emitters 140 are electrically at the same voltage potential as the plurality of targets 150. They may be at a ground potential, or any other potential. The plurality of electron emitters 140 generate a plurality of electron beams 164. The plurality of electron beams 164 emitted from the plurality of electron emitters 140 are accelerated through the vacuum chamber in cavity 136 toward the plurality of targets 150. The plurality of electron beams 164 emanating from the plurality of electron emitters 140 are incident on the plurality of targets 150 to produce X-rays 168. The plurality of targets 150 are at obtuse angles with respect to the plurality of incident electron beams 164.

The plurality of electron emitters 140 may be thermionic emitters or field emitters. For example, the plurality of electron emitters 140 may be field emitter arrays that are electrically gated and designed for emission of electrons into the vacuum chamber of cavity 136.

Microwaves generated by a microwave generator are coupled into cavity 136 of the waveguide 134 generate an electric field in the cavity 136 to accelerate the plurality of electron beams 164 from the plurality of electron emitters 140toward the plurality of targets 150 for generating X-rays 168.

Figure 5:
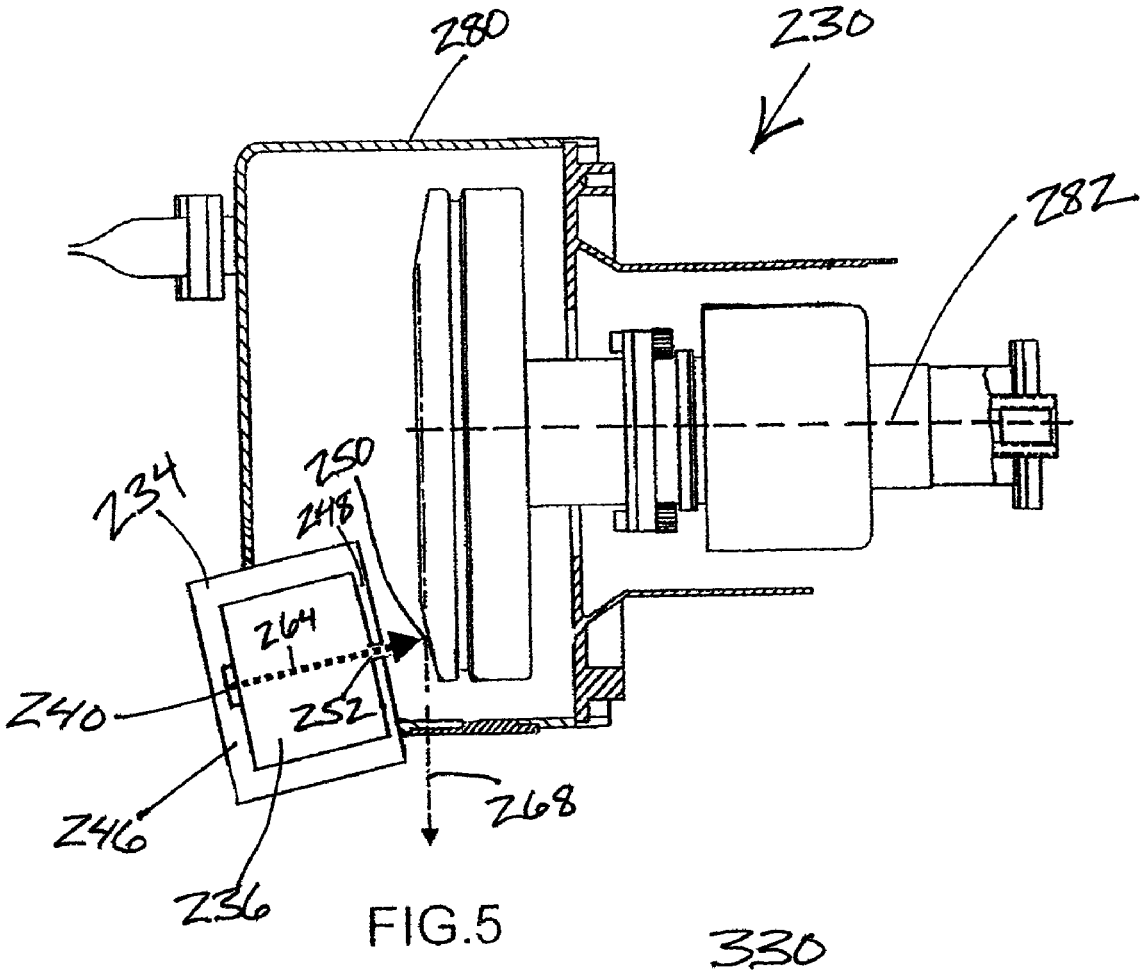
FIG. 5 is a cross-sectional view of an exemplary embodiment of an X-ray source.

FIG. 5 is a cross-sectional view of an exemplary embodiment of an X-ray source 230. The X-ray source 230 includes an X-ray tube 280 with a waveguide 234 coupled thereto. The waveguide 234 functioning as an accelerator for accelerating an electron beam 264 toward a rotating target 250 on the X-ray tube 280. The rotating target 250 rotates about an axis 282 and X-rays 268 are generated by the electron beam 264 striking the rotating target 268. The waveguide 234 having a cavity 236 extending therethrough, an electron emitter 240 positioned on a first sidewall 246 of waveguide 234, and an opening 252 extending through a second sidewall 248 of the waveguide 234. The second sidewall 248 being opposite the first sidewall 246.

The electron emitter 240 generates an electron beam 264 that is accelerated through the cavity 236 and the opening 252 in the second sidewall 248 toward the rotating target 250 of the X-ray tube 280 to produce X-rays 268. The electron emitter 240 may be a thermionic emitter or a field emitter.

Microwaves generated by a microwave generator are coupled into cavity 236 of the waveguide 234 and generate an electric field in the cavity 236 to accelerate the electron beam 264 toward-the rotating target 250. A microwave driven electron beam may be advantageous to replacing static high voltage means in traditional X-ray tubes.

Figure 6:
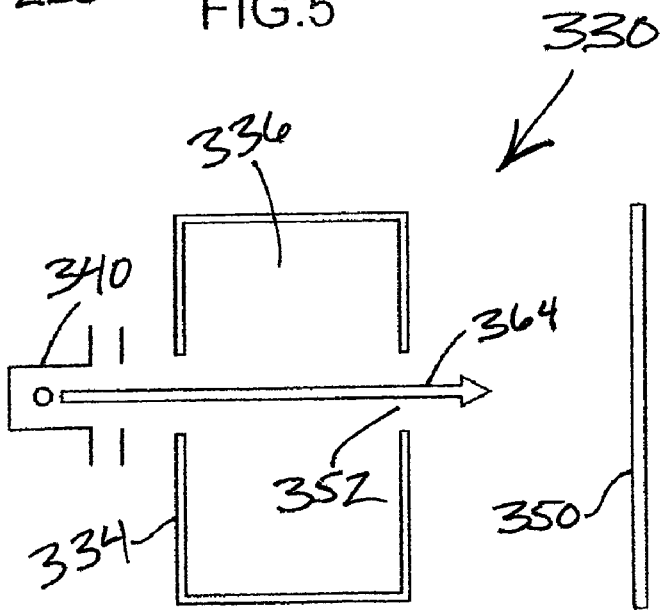
FIG. 6 is a cross-sectional view of an exemplary embodiment of an X-ray source.

FIG. 6 is a cross-sectional view of an exemplary embodiment of an X-ray source 330. In this embodiment, a waveguide 334 functioning as an accelerator is used to boost the energy of an electron beam 364 and accelerate the electron beam 364 as it exits a cathode, e-gun, or other electron emitter 340 and is directed toward a target 350. The electron emitter 340 can be operated below 10 kV, and the accelerator boosts the electron beam energy up to 100 to 200 kV.

The X-ray source 330 includes a waveguide 334 having a cavity 336 extending therethrough, an electron emitter 340 coupled to one side of waveguide 334, and an opening 352 extending through an opposite side of the waveguide 334. The electron emitter 340 generates an electron beam 364 that is accelerated through the cavity 336 and the opening 352 toward a target 350 to produce X-rays. Microwaves generated by a microwave generator are coupled into cavity 336 of the waveguide 334 generate an electric field in the cavity 336 to accelerate the electron beam 364 toward the target 350.

In an embodiment, a method for generating X-rays comprising emitting at least one electron beam from at least one electron emitter positioned at a first end of a waveguide, accelerating the at least one electron beam through a cavity within the waveguide with a microwave generated electric field coupled within the waveguide cavity, and directing the accelerated at least one electron beam to interact with at least one target positioned at a second end of the waveguide, the second end spaced apart and opposite the first end, for generating X-rays.

While the invention has been described with reference to various embodiments, those skilled in-the art will appreciate that certain substitutions, alterations and omissions may be made to the embodiments without departing from the spirit of the invention. Accordingly, the foregoing description is meant to be exemplary only, and should not limit the scope of the invention as set forth in the following claims.

What is claimed is:

1. An X-ray source comprising:

a waveguide having at least one sidewall and a cavity extending therethrough;

at least one electron emitter positioned on an inner surface of a first sidewall of the waveguide for generating at least one electron beam;

at least one an angled opening extending through a second sidewall, the at least one angled opening forming at least one pathway through the second sidewall, wherein the at least one pathway has two opposed sides;

at least one stationary target positioned on an inner surface of one of the two opposed sides of the at least one pathway, the at least one stationary target receiving the at least one electron beam for generating X-rays; and a conduit coupled through the at least one sidewall of the waveguide providing microwaves from a microwave generator into the cavity of the waveguide, the microwaves generating an electric field for accelerating the at least one electron beam toward the at least one stationary target;

wherein the second sidewall is opposite the first sidewall; and wherein the two opposed sides of the at least one pathway each having at least one cooling channel adjacent thereto and extending through the second sidewall.

2. The X-ray source of claim 1, wherein the at least one stationary target is positioned at an obtuse angle with respect to the at least one incident electron beam.

3. The X-ray source of claim 1, wherein the at least one stationary target is electrically at the same voltage potential as the at least one electron emitter.

4. The X-ray source of claim 1, wherein the at least one electron emitter is a field emitter.

5. The X-ray source of claim 4, wherein the field emitter is a field emitter array that is electrically gated.

6. The X-ray source of claim 1, wherein the at least one electron emitter is a thermionic emitter.

7. The X-ray source of claim 1, further comprising a radiation window attached to an outer surface of the second sidewall above the at least one target and covering the at least one pathway.

8. An annular X-ray source assembly comprising:

an annular waveguide having at least one sidewall and a cavity extending therethrough;

a plurality of electron emitters placed on an inner surface of a first sidewall of the annular waveguide for generating electrons that are accelerated through the waveguide cavity;

a plurality of stationary targets placed in a plurality of openings extending through a second sidewall, wherein the second sidewall is opposite the first sidewall, and wherein the plurality of stationary targets and plurality of openings are used to collimate X-rays and create a larger coverage area for an X-ray beam; and a conduit coupled through the at least one sidewall of the annular waveguide providing microwaves from a microwave generator into the cavity of the annular waveguide, the microwaves generating an electric field for accelerating the electrons toward the plurality of stationary targets.

9. The annular X-ray source of claim 8, wherein the plurality of stationary targets are positioned at an obtuse angle with respect to the incident electrons.

10. The X-ray source of claim 8, wherein the plurality of stationary targets are electrically at the same voltage potential as the plurality of electron emitters.

11. The annular X-ray source of claim 8, wherein the plurality of electron emitters are field emitters.

12. The annular X-ray source of claim 8, wherein the plurality of electron emitters are thermionic emitters.

* * * * *